United States Patent [19]

Yoshida

[11] 4,315,650

[45] * Feb. 16, 1982

[54] MECHANICAL HAND AMUSEMENT DEVICE

[75] Inventor: Kanji Yoshida, Tokyo, Japan

[73] Assignee: Tomy Corporation, Carson, Calif.

[ * ] Notice: The portion of the term of this patent subsequent to Jun. 24, 1997, has been disclaimed.

[21] Appl. No.: 134,119

[22] Filed: Mar. 26, 1980

Related U.S. Application Data

[63] Continuation of Ser. No. 959,225, Nov. 9, 1978, Pat. No. 4,208,830.

[51] Int. Cl.[3] ..... A47F 13/06

[52] U.S. Cl. ..... 294/19 R; 3/12.7; 46/1 R; 414/1

[58] Field of Search ..... 46/1 R, 116, 119, 120; 3/12, 12.6, 12.7; 414/1, 2; 294/19 A, 22, 19 R, 103 R, 103 CG, 104

[56] References Cited

U.S. PATENT DOCUMENTS

| | | | |
|---|---|---|---|
| 422,373 | 3/1890 | Caldwell | 56/332 |
| 747,376 | 12/1903 | Christman | 294/22 |
| 984,179 | 2/1911 | Aydt | 3/12.7 |
| 1,247,710 | 11/1917 | Nicola | 3/12.6 |
| 1,303,905 | 5/1919 | Jensen | 3/12.7 |
| 1,377,956 | 5/1921 | Anderson | 3/12.6 |
| 1,587,780 | 6/1926 | Laherty | 3/12.6 |
| 2,429,001 | 10/1947 | Stone | 3/12.7 |
| 2,500,614 | 3/1950 | Lohmann | 3/12.7 |
| 2,545,452 | 3/1951 | Fletcher | 3/12.7 |
| 2,556,524 | 6/1951 | Drennon | 3/12.7 |
| 2,633,670 | 4/1953 | Stevber | 46/154 |
| 2,733,545 | 2/1956 | Nicola | 46/126 |
| 2,790,437 | 4/1957 | Moore | 128/2 |
| 3,031,683 | 5/1962 | Hellwig | 294/19 A |
| 3,153,881 | 10/1964 | Baulard-Cogan | 46/126 |
| 3,212,213 | 10/1965 | Perego | 46/135 |
| 3,413,658 | 12/1968 | Becker | 3/12.7 |
| 3,731,427 | 5/1973 | Lewis et al. | 46/120 |
| 3,733,743 | 5/1973 | Kossoff et al. | 46/228 |
| 3,893,257 | 7/1975 | Miki | 46/126 |
| 4,208,830 | 6/1980 | Yoshida | 3/12.7 |

FOREIGN PATENT DOCUMENTS

| | | | |
|---|---|---|---|
| 1457651 | 9/1965 | France | 294/19 A |

*Primary Examiner*—Paul J. Hirsch
*Attorney, Agent, or Firm*—Staas & Halsey

[57] ABSTRACT

A mechanical hand amusement device consisting of a movable grip member joined by a rod, which extends through a tubular arm, to a hand member having a fixed thumb and four finger members which bend inward when the grip member is squeezed. Each finger member includes three hollow segments which are joined by flexible hinges at the tops, and have a flexible strap which is anchored within the fingertip segment running along the bottoms. The strap extending through each of the finger members is coupled to the rod so that a portion of the strap is retracted into the hand member when the grip member is squeezed. The resulting forces move the finger members inward in a grasping motion. A spring within the hand member returns the elements to their at-rest positions when the grip member is released.

15 Claims, 6 Drawing Figures

MECHANICAL HAND AMUSEMENT DEVICE

This is a continuation of application Ser. No. 959,225 filed Nov. 9, 1978 now U.S. Pat. No. 4,208,830.

BACKGROUND AND SUMMARY OF THE INVENTION

The present invention relates to an amusement device, and in particular, to a mechanical hand amusement device having a fixed thumb and movable fingers which curl inward when a grip member is squeezed. Upon release of the grip, which is positioned at the end of the tubular arm, a spring within the hand member restores the grip member to its normal position and allows the fingers to uncurl. Small resilient fingertip members are provided at the ends of the finger tips to increase gripping power.

The body of each of the finger members is formed by a single plastic element having three hollow segments joined at the top by flexible hinges. The segments are not joined at the bottoms, which are smaller than the tops so as to allow bending motion. A flexible strap is tethered at the fingertip segment of each finger and extends through and along the bottom of the remaining segments into the hand member, where it is coupled to the rod. Squeezing the grip member causes the straps to be retracted into the hand member, thereby curling the finger members inward towards the palm.

DESCRIPTION OF THE PREFERRED EMBODIMENT

Figure 1:
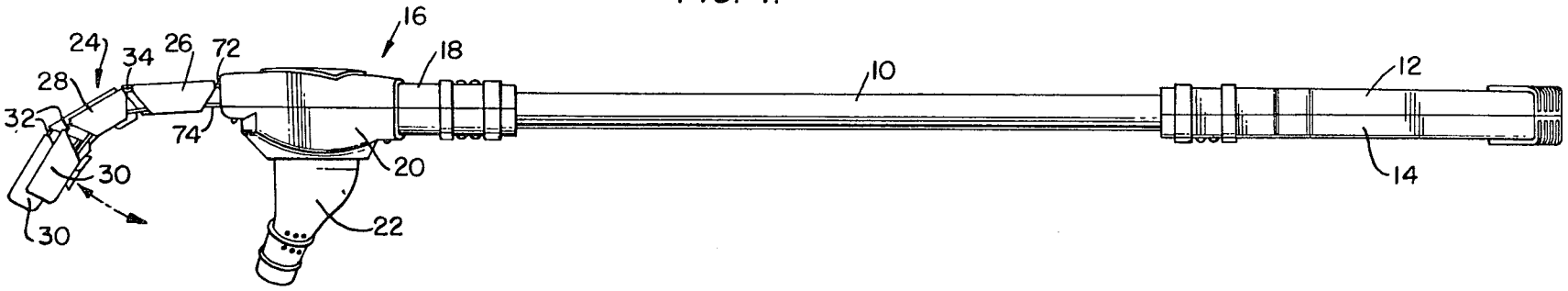
FIG. 1 is a side view of the mechanical hand amusement device of the present invention, illustrating generally the grasping motion of the movable finger members.

The mechanical hand amusement device of the present invention is generally illustrated in FIG. 1, and includes tubular arm 10 having top handle 12 and lower handle 14 at one end thereof, and hand member 16 at the other end. Hand member 16 includes top hand member 18, palm member 20, and digits such as fixed thumb member 22 and four movable finger members 24. Each movable finger member 24 includes a first segment 26, a second segment 28, and a third segment 30, segments 28 and 30 being joined by flexible hinge 32, and segments 26 and 28 being joined by flexible hinge 34.

Figure 2:
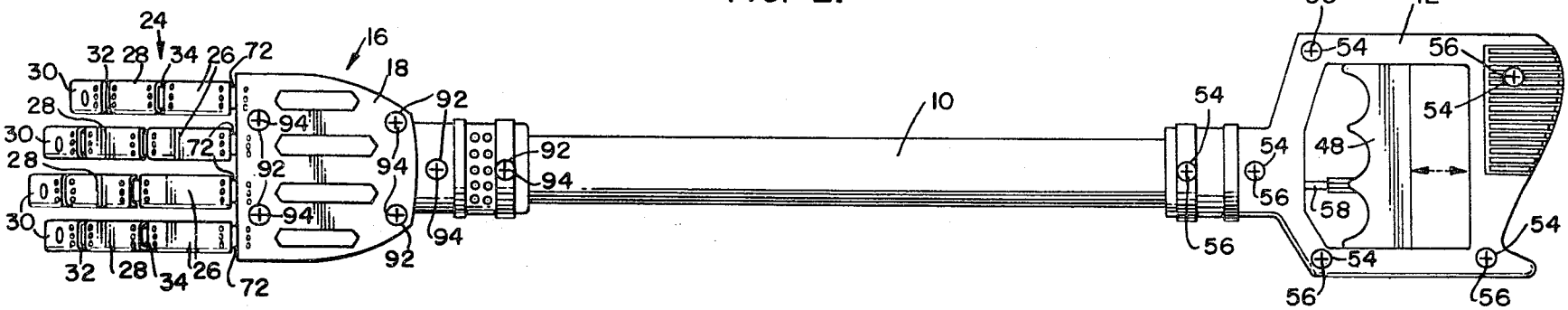
FIG. 2 is a top plan view of the amusement device showing generally the motion of the grip which controls the flexing and unflexing of the finger members.
Figure 3:
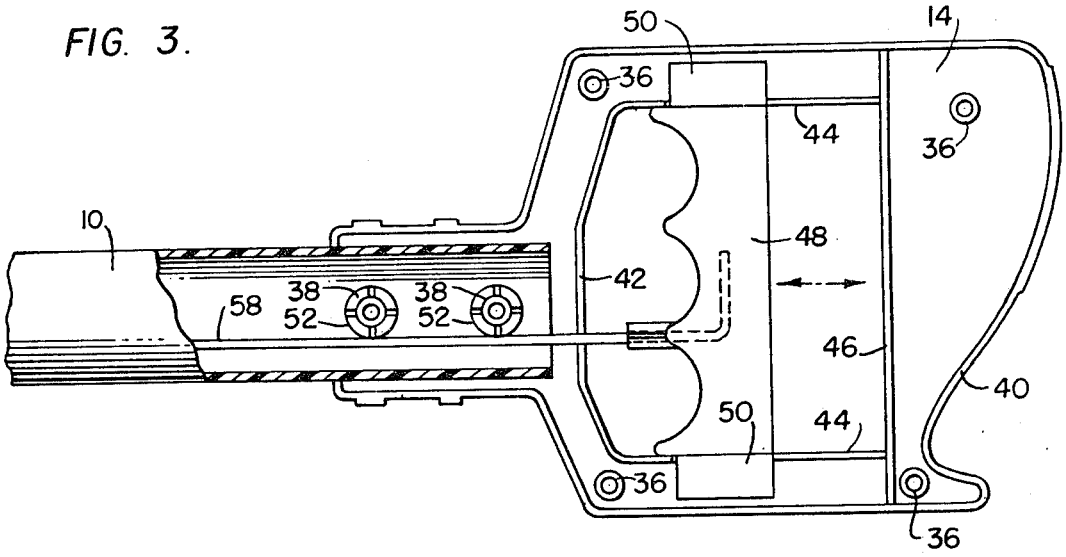
FIG. 3 is a top plan view of the handle with the top portion removed, illustrating the movement of the grip and reciprocation of the rod extending through the tubular arm.

Turning now to FIG. 3, lower handle 14 is provided with small threaded cylinders 36, large threaded cylinders 38, and flanges 42, 44 and 46. Flanges 44 are of lesser height than flanges 40, 42 and 46, so as to accommodate projections 50 of grip member 48 and thereby allow grip 48 to undergo reciprocating movement when it is squeezed and released. Threaded cylinders 38 project through mounting holes 52 in tubular arm 10 so as to securely mount arm 10. As is seen in FIG. 2, top handle 12 is provided with holes 54 through which screws 56 extend so as to join top handle 12 and lower handle 14. Metal rod 58 is embedded in grip 48 and extends through tubular arm 10 to hand member 16.

Figure 4:
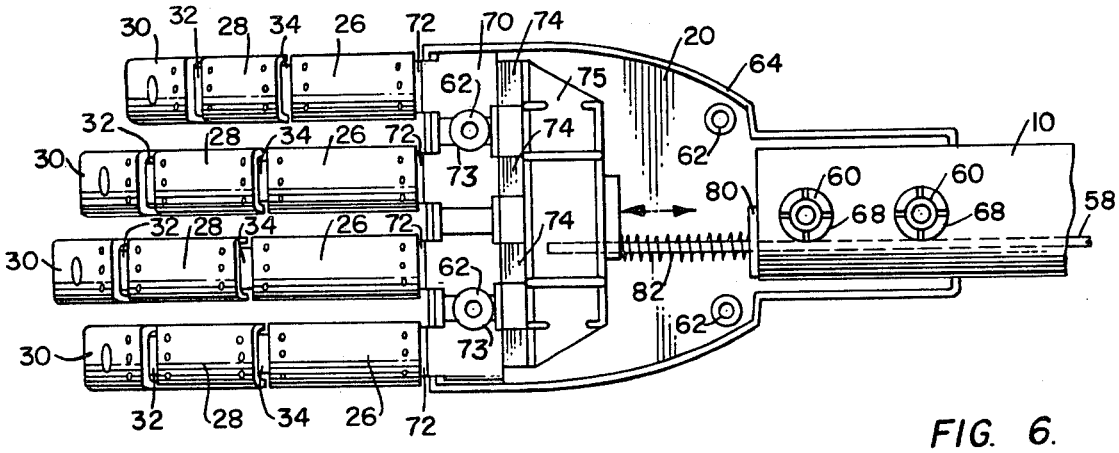
FIG. 4 is a top plan view of the hand member with the top portion removed; illustrating the connection of the rod to the displaceable member to which the straps are secured.

Turning now to FIG. 4, palm member 20 is provided with threaded cylinders 60 and 62, along with flange 64 which has four slots 66 (not shown) through which finger members 24 extend. Threaded cylinders 60 extend through holes 68 in tubular arm 10 so as to securely mount hand member 16 to tubular arm 10. Element 70, which is joined to the segments 26 by flexible hinges 72, is provided with holes 73 through which threaded cylinders 62 extend so as to firmly mount element 70 within the hand member 16. Element 70 is also provided with four openings 71 (not shown), whose purpose will be described later, corresponding to the fingers 24.

Figure 5:
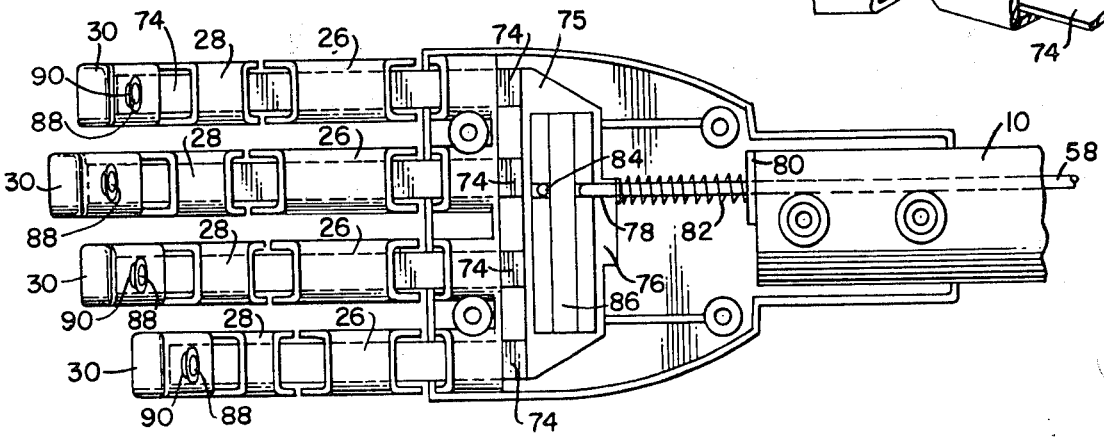
FIG. 5 is a bottom plan view of the hand member with the palm member removed.

Turning now to FIG. 5, displaceable member 75 is provided with four flexible straps 74, and flange 76 having notch 78. Rod 58 extends through washer 80, spring 82, and notch 78 into the interior region of displaceable member 75. There hook 84 at the end of rod 58 engages metal strip 86, which is fixably secured to displaceable member 75. It will be apparent that when grip member 48 is squeezed, rod 58 will transmit motion through tubular arm 10 and cause displaceable member 75 to be retracted towards tubular arm 10. Moreover, when grip member 48 is released, the tension of spring 82 will restore displaceable member 75 and grip member 48 to their former positions.

With continuing reference to FIG. 5, each of the straps 74 extends through an opening 71 in element 70, segment 26, segment 28, and is fixably attached to the inside of the terminal segment 30 by a rivet 88. In addition to securing strap 74, the rivets 88 also mount rubber fingertip members 90 outside the segments 30 to increase gripping power.

Turning now to FIG. 2, top hand member 18 is provided with holes 92 through which screws 94 extend to secure top hand member 18 and palm member 20, with element 70 and displaceable member 75 encased between them.

Figure 6:
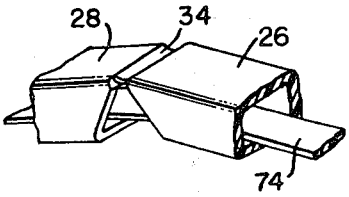
FIG. 6 is a perspective view of a portion of a finger member showing two hollow segments joined by a hinge at the top and having a flexible strap positioned along the bottom thereof.

With reference to FIGS. 4, 5, and 6, the operation of the invention can now be explained. It is apparent that the total distance between element 70 and the end of each outstretched finger members 24 is equal to the length of segments 26, 28 and 30, in addition to the smaller lengths of hinges 32, 34 and 72. When grip member 48 is squeezed, however, the effective length of the straps 74 extending along the bottoms of the finger members 24 is decreased. It will be noted that spacers can be provided upon the strap 74, and hidden from sight within segments 28 and 30, so as to loosely hold the straps 74 at the bottoms of the finger members 24. It is apparent that squeezing grip member 48 decreases the length at the bottom of each finger member 24 with respect to the top of the same member. Under the influence of the forces thus created, hinges 32, 34 and 72 flex in simulation of the movement of the human hand. The fingers move inward in a grasping motion and can clasp objects against fixed thumb member 22. When grip member 48 is released spring 82, which has been squeezed between washer 80 and flange 76, expands and restores grip member 48 and displaceable member 75 to their at-rest positions. The force of spring 82, in addition to the natural resilience of the hinges 32, 34, and 72, cause the finger members 24 to extend outward to an open-hand position.

I claim:

1. An amusement device comprising:

a tubular arm;

a grip member movably mounted at one end of the said arm;

a hand member mounted at the other end of said arm, said hand member having at least one movable digit having a plurality of hollow segments joined by first flexible hinges;

a flexible strap corresponding to each said at least one movable digit, said strap being fixed to the terminal segment of said at least one movable digit and extending through the remaining segments; and means connecting said grip and the strap corresponding to each said at least one movable digit for curling said at least one movable digit when said grip is squeezed, said means additionally restoring said grip member and said at least one movable digit to their former positions when said grip member is no longer squeezed, wherein said means comprises a rod connected to said grip member and extending through said tubular arm into said hand member, a displaceable member linearly movable within said hand member, said displaceable member being attached to said rod and to the strap corresponding to each said at least one movable digit, and spring means disposed between said arm and said displaceable member for biassing said displaceable member away from said arm.

2. The amusement device of claim 1, wherein said spring means comprises: a cylindrical spring wrapped around said rod, one end of said cylindrical spring pressing against said displaceable member.

3. The amusement device of claim 1, wherein said hand has four movable finger members and a fixed thumb member, each of said finger members having three segments.

4. The amusement devics of claim 2, wherein said hand has four movable finger members and a fixed thumb member, each of said finger members having three segments.

5. The amusement device of claim 4, further comprising four resilient fingertip members, one of said fingertip members being attached to the terminal segment of each finger member.

6. The amusement device of claim 4, further comprising an element fixedly mounted within said hand member, each of said finger members being attached to said element by a further flexible hinge.

7. The amusement device of claim 6, wherein said element has four openings therein, each of said openings corresponding to one of said finger members, said straps extending from said displaceable member to said finger members through said openings.

8. An amusement device, comprising:

a tubular arm, a grip member movably mounted at one end of said tubular arm;

a hollow hand member having a wrist end and a finger end, said tubular arm being attached to said hand member at the wrist end thereof, the finger end of said hand member having at least one slot therein;

at least one movable finger member having a plurality of hollow segments joined by first flexible hinges;

an element fixedly mounted within said hand member and positioned at the finger end thereof adjacent said at least one slot;

at least one further flexible hinge extending through said at least one slot to movably join said at least one finger member to said element;

a linearly movable displaceable member positioned within said hand member between the wrist end thereof and said element;

means extending through said tubular arm for operatively connecting said displaceable member and said grip member;

a flexible strap corresponding to each said at least one finger member, said strap having one end thereof fixed to the terminal segment of said at least one finger member and the other end thereof fixed to said displaceable member; and spring means for biassing said displaceable member toward said element.

9. The amusement device of claim 8, wherein said element has a first opening therein corresponding to each said at least one finger member, the strap corresponding to each said at least one finger member extending through the corresponding first opening.

10. The amusement device of claim 9, wherein the finger end of said hand member has four slots therein, wherein there are four finger members having a plurality of hollow segments joined by first flexible hinges, each finger member corresponding to one of the slots, wherein there are four further flexible hinges, each further hinge corresponding to one of the finger members and extending through one of the slots to movably join the corresponding finger member to said element, wherein said element has four first openings therein, each first opening corresponding to one of the finger members, and wherein there are four flexible straps, each strap corresponding to one of the finger members and extending through the corresponding first opening in said element, one end of each strap being fixed to the terminal segment of the corresponding finger member and the other end being fixed to said displaceable member, and further comprising a fixed thumb member mounted on said hand member.

11. The amusement device of claim 10, wherein said hand member comprises a top member having two holes disposed therein adjacent the finger end, a palm member having two first threaded cylinders extending towards the two holes adjacent the finger end in said top member, and two screws extending through the holes adjacent the finger end in the top member to the first threaded cylinders of the palm member joining the top member and the palm member, and wherein said element fixedly mounted within said hand member has two second openings therein through which said first threaded cylinders pass to fixedly mount said element.

12. The amusement device of claim 11, wherein said top member has two holes therein disposed adjacent the wrist end, wherein said palm member has two second threaded cylinders extending towards the two holes adjacent the wrist end in the top member, and wherein said tubular arm has two holes adjacent the end thereof attached to said hand member through which said second threaded cylinders pass, and further comprising two screws extending through the holes adjacent the wrist end in said top member to the second threaded cylinders of the palm member to join said top and palm members and to attach said tubular arm thereto.

13. The amusement device of claim 8, 9, 10, 11, or 12, wherein said means for operatively connecting said displaceable member and said grip member comprises a rod extending through said tubular arm, one end of said rod being attached to said grip member and the other end of said rod being operatively connected to said displaceable member, and wherein said spring means comprises a cylindrical spring wrapped around said rod, said spring being positioned within said hand member between the wrist end thereof and said displaceable member.

14. The amusement device of claim 13, further comprising means positioned between said spring and said tubular arm for retaining said spring within said hand member.

15. The amusement device of claim 14, wherein said means for retaining said spring within said hand member comprises a disc element having an opening therein through which said rod extends, one side of said disc element abutting one end of said tubular arm and the other side of said disc element abutting one end of said spring.

* * * * *